US006347206B1

(12) United States Patent
Jinzai

(10) Patent No.: US 6,347,206 B1
(45) Date of Patent: Feb. 12, 2002

(54) IMAGE FORMING APPARATUS CAPABLE OF FORMING IMAGES ON BOTH FACES OF RECORDING MATERIALS

(75) Inventor: Makoto Jinzai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/599,949

(22) Filed: Jun. 23, 2000

(30) Foreign Application Priority Data

Jun. 24, 1999 (JP) ..... 11-178986

(51) Int. Cl.[7] ..... G03G 15/00; B21B 27/06
(52) U.S. Cl. ..... 399/159; 399/116; 219/469
(58) Field of Search ..... 219/216, 469; 399/44, 116, 159

(56) References Cited

U.S. PATENT DOCUMENTS 4,659,206 A * 4/1987 Kai et al. ..... 399/159
5,019,862 A * 5/1991 Nakamura et al. ..... 399/159
5,450,167 A * 9/1995 Okano et al. ..... 399/159
5,572,275 A 11/1996 Jinzai ..... 399/331
5,717,988 A 2/1998 Jinzai et al. ..... 399/333

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An image forming apparatus for forming an image on a recording material includes an image bearing member, a heater for heating the image bearing member, and a control device for controlling the heater so that a temperature of the image bearing member is maintained at a set temperature, wherein the set temperature when images are formed on both faces of a recording material is set to be lower than the set temperature when an image is formed on one face of a recording material.

8 Claims, 6 Drawing Sheets

FIG. 7

| | EMBODIMENT 1 | | CONVENTIONAL EXAMPLE 1 | | COMPARATIVE EXAMPLE 1 | |
|---|---|---|---|---|---|---|
| | ONE-FACE | BOTH-FACE | ONE-FACE | BOTH-FACE | ONE-FACE | BOTH-FACE |
| BOTH-FACE FORMING METHOD | — | THROUGH PATH | — | INTERMEDIATE TRAY | — | THROUGH PATH |
| DRUM ATTEMPERRING TEMPERATURE | 40 °C | 35 °C | 40 °C | 40 °C | 40 °C | 40 °C |
| DRUM SURFACE TEMPERATURE (WHEN SATURATED) | 35 °C | 36 °C | 35 °C | 36 °C | 35 °C | 44 °C |
| CLN PERFORMANCE | ○ | ○ | ○ | ○ | ○ | × |
| IMAGE FORMATION NUMBER PER UNIT OF TIME [SHEET/MINUTE] | 60 | 60 | 60 | 40 | 60 | 60 |

○ : GOOD, × : BAD

IMAGE FORMING APPARATUS CAPABLE OF FORMING IMAGES ON BOTH FACES OF RECORDING MATERIALS

BACKGROUND OF THE INVENTION

1. Field of the Invention

The present invention relates to an image forming apparatus of the electrophotographic process such as a copying machine, a printer or a facsimile machine, and more particularly to an image forming apparatus having a function of forming images on both faces of a recording material.

2. Related Background Art

FIG. 6 shows a cross-sectional view of a copying machine which is capable of forming images on both faces of a recording material.

The image forming apparatus shown in FIG. 6 is designed so that a surface of an image bearing member (photosensitive drum) 1 that rotates in a direction indicated by an arrow R1 is uniformly charged by a charger 2, and an electrostatic latent image is formed by the exposure of exposure means 3. Toner is attached onto the electrostatic latent image and developed as a toner image by a developing device 4. The toner image on the image bearing member 1 is transferred by a transfer charger 5 onto a transfer material P such as paper which is fed and conveyed through a feeding path 12 from a sheet feed cassette 11 by feeding means such as a sheet pickup roller and a conveying roller. The toner (untransferred toner) remaining on the surface of the image bearing member 1 from which the toner image has been transferred, which has not been transferred onto the transfer material P is removed by a cleaning blade (cleaning device) 6. On the other hand, the transfer material P onto which the toner image has been transferred is conveyed to a fixing device (heating portion) 7 by a conveying belt 13, and heated and pressurized by a fixing roller 7*a* and a pressure roller 7*b* so that the toner image is fixed onto the surface of the transfer material P. In the case where the toner image is formed on only one face (first face) of the transfer material P, a flapper 14 is disposed at a position shown in FIG. 6 whereby the transfer material P onto which the image has been formed is discharged to the external by a sheet discharge roller 15, thus completing the image formation.

On the other hand, in the case where the toner images are formed on both faces (first face and second face) of the transfer material P, after the toner image has been fixed on the first face as described above, the sheet discharge roller 15 is stopped immediately after a tailing end of the transfer material P passed through the flapper 14, and the flapper 14 is changed over to reversely rotate the sheet discharge roller 15. As a result, the transfer material P is conveyed to a re-conveying belt 31 disposed in a re-feeding path 30 while the transfer material P is guided by a lower face of the flapper 14, and then contained into an intermediate tray 32. After the formation of images on the first faces of the transfer materials P of a given number has been completed and the transfer materials P of the given number have been contained in the intermediate tray 32, the formation of images on the second faces of the transfer materials P starts. The transfer material P within the intermediate tray 32 is fed by a re-feed belt 33 and again supplied to the image bearing member 1 through the feeding path 12. With this operation, the toner image formed on the photosensitive drum 1 is transferred onto the second face of the transfer material P. The transfer material P onto the second face of which the toner image has been transferred is discharged to the exterior of an image forming apparatus body by the sheet discharge roller 15 after the toner image has been fixed onto the second face of the transfer material P in the same manner as in the above-described case where the toner image is formed on only the first face of the transfer material P. As a result, the formation of images on the first and second faces of the transfer material P has been completed.

In the above-described image forming apparatus, a sheet heater 22 is embedded in the image bearing member 1 as shown in FIG. 6 and heats the surface of the image bearing member 1 to a temperature of about 40 to 50° C. which is slightly higher than the room temperature under the control. The purposes of heating the surface of the image bearing member 1 are as follows:

(1) Prevention of Smeared Image:

If a large number of one-face copies are continuously conducted under the circumstances of high temperature and high humidity, because the temperature of the image bearing member is lowered, water molecules are adsorbed on the surface of the image bearing member to lower the surface resistance, the electrostatic latent image is disordered. In order to prevent the above drawback, the warmth of the image bearing member is retained so that the water molecules can be appropriately heated and evaporated.

(2) Stabilization of Photosensitive Characteristics:

In the case where the image bearing member is formed of a photosensitive member, the photosensitive property such as a charging capability or a dark decay depends on temperature, and it is desirable to hold the surface temperature constant in order to hold those characteristics constant.

(3) Stabilization of Cleaning Characteristics:

Because the cleaning blade is generally made of urethane rubber, those visco-elastic characteristic depends on temperature, and therefore it is desirable to hold the temperature constant.

In order to achieve the above-described purposes, the surface temperature of the image bearing member 1 is detected by a thermistor 21, and the on/off operation of power supply to the sheet heater 22 is controlled on the basis of the detected result by control means 23 so that the surface temperature of the image bearing member 1 is controlled to the above-described temperature of 40 to 50° C.

Incidentally, a method of forming the images on both faces of the transfer material by using the intermediate tray 32 as shown in FIG. 6 is effective in an analog copying machine in which a light is irradiated onto an original and its reflected light is directly irradiated onto a photosensitive member to form an image on the photosensitive member. The reason is stated below. That is, in case of the analog copying machine, the replacing work of the original (or reverse work) is required to copy different images on both faces of the recording material (transfer material). In order to reduce a copying wait time during the replacing work, a method in which one-face copying is conducted on the recording materials as many as possible without replacing the original by another original, the original is thereafter replaced by another original and an image on another original is copied on a back surface of the recording material on a front surface of which an image has been copied is desirable to increase the copying speed. However, if no intermediate tray is provided, a large number of recording materials one surface of which has been copied cannot be stored. Therefore, it is necessary to again return to the first original sooner.

On the other hand, in case of the digital copying machine adapted to form an image on a photosensitive member in response to an image signal, if the image data of every plural originals is saved, the first-original image and the second-original image can be formed on the photosensitive member at random without requiring the wait time for the original replacement as in the analog copying machine. As a result, a large number of both-face copies can be rapidly conducted even if no intermediate tray is provided. Accordingly, the recording material one face of which has been copied and which stops once on the intermediate tray in the analog copying machine can be again conveyed at the transfer position of the photosensitive member without stopping halfway in the digital copying machine.

When only one face of the transfer material P is thus copied by the copying machine using no intermediate tray, because the transfer material P absorbs more than a little heat from the image bearing member 1, the temperature of the image bearing member is lowered. On the contrary, in the image forming process for forming images on both faces of the transfer material, the image forming process for the second face is again sequentially conducted (after a short period of time) after the transfer material P has passed through the fixing device 7 at the time of the image formation for the first face. For that reason, the heat given to the transfer material P from the fixing device 7 is given to the image bearing member 1 during the transfer process with the result that the image bearing member 1 rises in temperature. In this case, the toner attached on an edge face of the cleaning blade 6 which is in contact with the image bearing member 1 is agglomerated and consolidated by the influence of the pressure and heat, resulting in a deterioration of the cleaning performance.

SUMMARY OF THE INVENTION

The present invention has been made in view of the above-described problems, and therefore an object of the present invention is to provide an image forming apparatus which is capable of performing both of one-face copying and both-face copying with a high quality.

Another object of the present invention is to provide an image forming apparatus which suppresses the rising of temperature of an image bearing member when conducting both-face copying.

Still another object of the present invention is to provide an image forming apparatus, including: an image bearing member; a heater for heating the image bearing member; and control means for controlling the heater so that a temperature of the image bearing member is maintained at a set temperature, wherein the set temperature when images are formed on both faces of a recording material is set to be lower than the set temperature when an image is formed on one face of a recording material.

Yet still another object of the present invention is to provide an image forming apparatus, including: an image bearing member; a heater for heating the image bearing member; and control means for controlling the heater so that a temperature of the image bearing member is maintained at a set temperature, wherein the control means controls the temperature of the image bearing member when an image is formed on one face of a recording material, and continues to turn off a power supply to the heater when an image is formed on both faces of a recording material.

Other objects of the present invention will become apparent by reading the following detailed description with reference to the accompanying drawings.

BRIEF DESCRIPTION OF THE DRAWINGS

These and other objects, features and advantages of this invention will become more fully apparent from the following detailed description taken with the accompanying Drawings in which:

FIG. 7 is a table representing the evaluated results of Embodiment 1, Comparative example 1 and Conventional example 1.

DESCRIPTION OF THE PREFERRED EMBODIMENTS

Now, a description will be given in more detail of preferred embodiments of the present invention with reference to the accompanying drawings.

(Embodiment 1)

Figure 1:
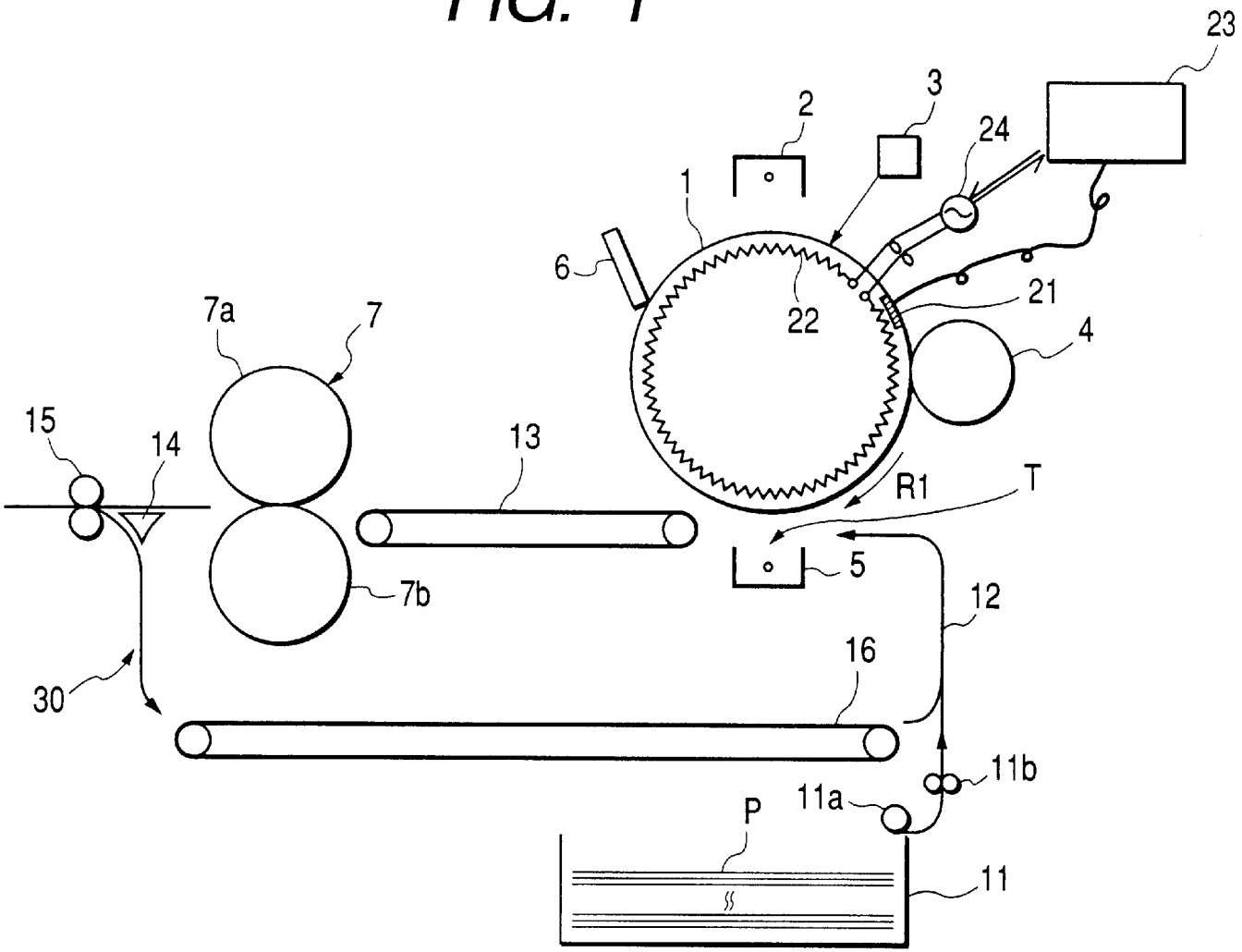
FIG. 1 is a vertical cross-sectional view showing the schematic structure of an image forming apparatus in accordance with Embodiment 1 of the present invention.

FIG. 1 shows an example of an image forming apparatus in accordance with the present invention. The image forming apparatus shown in FIG. 1 is directed to an electrophotographic printer (digital copying machine) which is capable of automatically forming an image on both faces (the first face and the second face) of a transfer material P. FIG. 1 shows a vertical cross-sectional view showing the schematic structure of the image forming apparatus.

First, the outline of the entire image forming apparatus will be described with reference to FIG. 1.

The printer shown in FIG. 1 (hereinafter referred to as "image forming apparatus") uniformly charges the surface of an image bearing member (for example, a photosensitive drum: an amorphous silicon photosensitive member in this embodiment) 1 which rotates in a direction indicated by an arrow R1 by a charger 2 and forms an electrostatic latent image by exposure of exposing means 3 that outputs a light in response to an image signal. Toner is attached onto the electrostatic latent image and developed as a toner image by a developing device 4. The toner image on the image bearing member 1 is transferred by a transfer charger 5 to the transfer material P such as a paper, which is fed and conveyed through a feeding path 12 from a sheet feed cassette 11 by a sheet pickup roller 11*a* and a conveying roller 11*b*, at a transfer portion T where the image bearing member 1 and the transfer charger 5 are opposed to each other. In this embodiment, the sheet pickup roller 11*a*, the conveying roller 11*b* and so on constitute feeding means. The toner (untransferred toner) remaining on the surface of the image bearing member 1 from which the toner image has been transferred, which has not been transferred onto the transfer material P is removed by a cleaning blade (cleaning device) 6. On the other hand, the transfer material P onto which the toner image has been transferred is conveyed to a fixing device 7 by a conveying belt 13, and heated and pressurized by a fixing roller 7*a* and a pressure roller 7*b* so that the toner image is fixed onto the surface of the transfer material P. A flapper 14 is disposed at a position shown in FIG. 1 so that the transfer material P onto which the image has been fixed is discharged to the external by a sheet discharge roller 15. With the above operation, the formation of an image on one face (the first face) of the transfer material P (an image formation in an one-face mode) is completed.

As shown in FIG. 1, in the above-described image forming apparatus, a sheet heater (sheet-shaped heating element) 22 is embedded in the image bearing member 1 as heating means. The sheet heater 22 is in close contact with an inner wall of a cylindrical drum substrate that constitutes the image bearing member 1 and connected to a power supply 24. Likewise, a thermistor (temperature detecting means) 21 for detecting the temperature of the image bearing member 1 is also in close contact with the inner wall of the drum substrate. In FIG. 1, the reference numeral 23 denotes control means for controlling the entire image forming apparatus, and the control means 23 is connected to the power supply 23 and the thermistor (temperature detecting means) 21 so as to control the power supply 24 on the basis of an output signal from the thermistor 21, thus controlling the power supply to the sheet heater 22. As a result, the temperature of the image bearing member 1 is controlled to a set temperature.

Subsequently, an image forming process in a both-face mode will be described.

After the toner image is fixed on the first face of the transfer material P in the same manner as those described above, the sheet discharger roller 15 is stopped immediately after a tailing end of the transfer material P has passed through the flapper 14, and the flapper 14 is then changed over to reversely rotate the sheet discharge roller 15 that also serves as a surface reverse roller. Thereafter, the transfer material P is guided by a lower surface of the flapper 14 and then conveyed to a re-conveying belt 16 disposed in a re-feeding path 30. With this operation, a front surface and a back surface of the transfer material P are resultantly reversed. In this embodiment, the sheet discharge roller 15 and the re-conveying belt 16 constitute re-feeding means. The transfer material P which has been conveyed to the re-conveying belt 16 is again fed to the image bearing member 1 through the above-described feeding path 12 without being stopped. As a result, the toner image formed on the photosensitive drum 1 is transferred onto the second face of the transfer material P. The transfer material P onto the second face of which the toner image has been transferred is discharged to the external of an image forming apparatus body by the sheet discharge roller 15 after the toner image has been fixed onto the second face of the transfer material P in the same manner as in the above-described case where the toner image is formed on only the first face of the transfer material P. As a result, the formation of images on the first face and the second face of the transfer material P is automatically completed.

Figure 2:
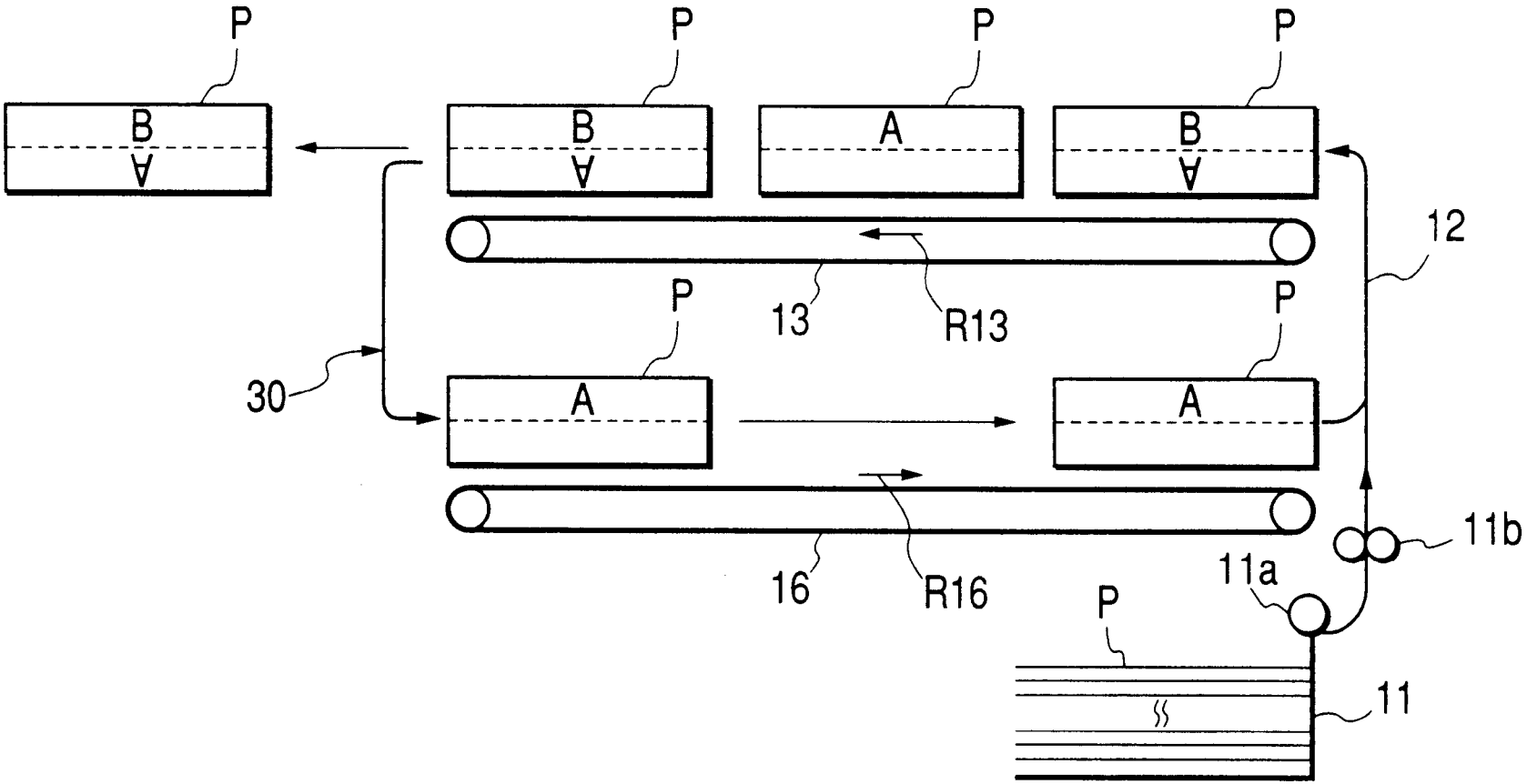
FIG. 2 is a diagram for explaining a sequence in which an image A is formed on a first surface of a transfer material P and an image B is formed on a second surface thereof in a both-face mode.

Subsequently, a sequence of forming an image when the images are formed on the first face and the second face of the transfer material P will be described with reference to FIG. 2. The fixing device 7 is omitted from FIG. 2. In FIG. 2, the reference A denotes an image formed on the first face of the transfer material P whereas the reference B denotes an image formed on the second face of the transfer material P. As shown in FIG. 2, the image formation is first made in such a manner that the transfer materials P are continuously fed from the sheet feed cassette 11 at a time interval twice as long as that at the time of the continuous image formation in the one-face mode, and the image A is formed on those transfer materials P. In other words, an interval as long as one sheet of transfer material P is provided between a preceding transfer material P and a subsequent transfer material P. After the transfer material P on which the image A has been formed is conveyed by the re-conveying belt 16 disposed in the re-feed path 30 to enable re-feed to the feeding path 12, the transfer materials P are fed to the image bearing member 1 through the feeding path 12 alternately from the sheet feed cassette 11 and the re-conveying belt 16. In other words, the image A is formed on the transfer material P fed from the sheet feed cassette 11 whereas the image B is formed on the transfer material P on which the image A has been already formed and which has been re-supplied from the re-conveying belt 16. The transfer material P on which the image B has been thus formed is discharged to the external of the image forming apparatus body as a transfer material P on both faces of which the images have been formed. On the other hand, the transfer material P on which the image A has been formed is conveyed to the re-feeding path 30 so that the image B is subsequently formed on the transfer material P. The transfer material P to be supplied to the transfer portion T is supplied from the sheet feed cassette 11 or the re-conveying belt 16 under the control by the above-described control means 23, and in this embodiment, control is made such that the transfer materials P are alternately supplied from both of the sheet feed cassette 11 and the re-conveying belt 16. With the above structure (called "through-pass both-face system"), in the image forming apparatus shown in FIG. 1 according to this embodiment, it is unnecessary to stop the transfer material P once at the time of the both-face image formation, and it is possible to make a state in which the transfer materials P as many as possible exist in the conveying path (12, 13, 30, 16) with the result that the number of output sheets per unit of time can be significantly improved.

Figure 6:
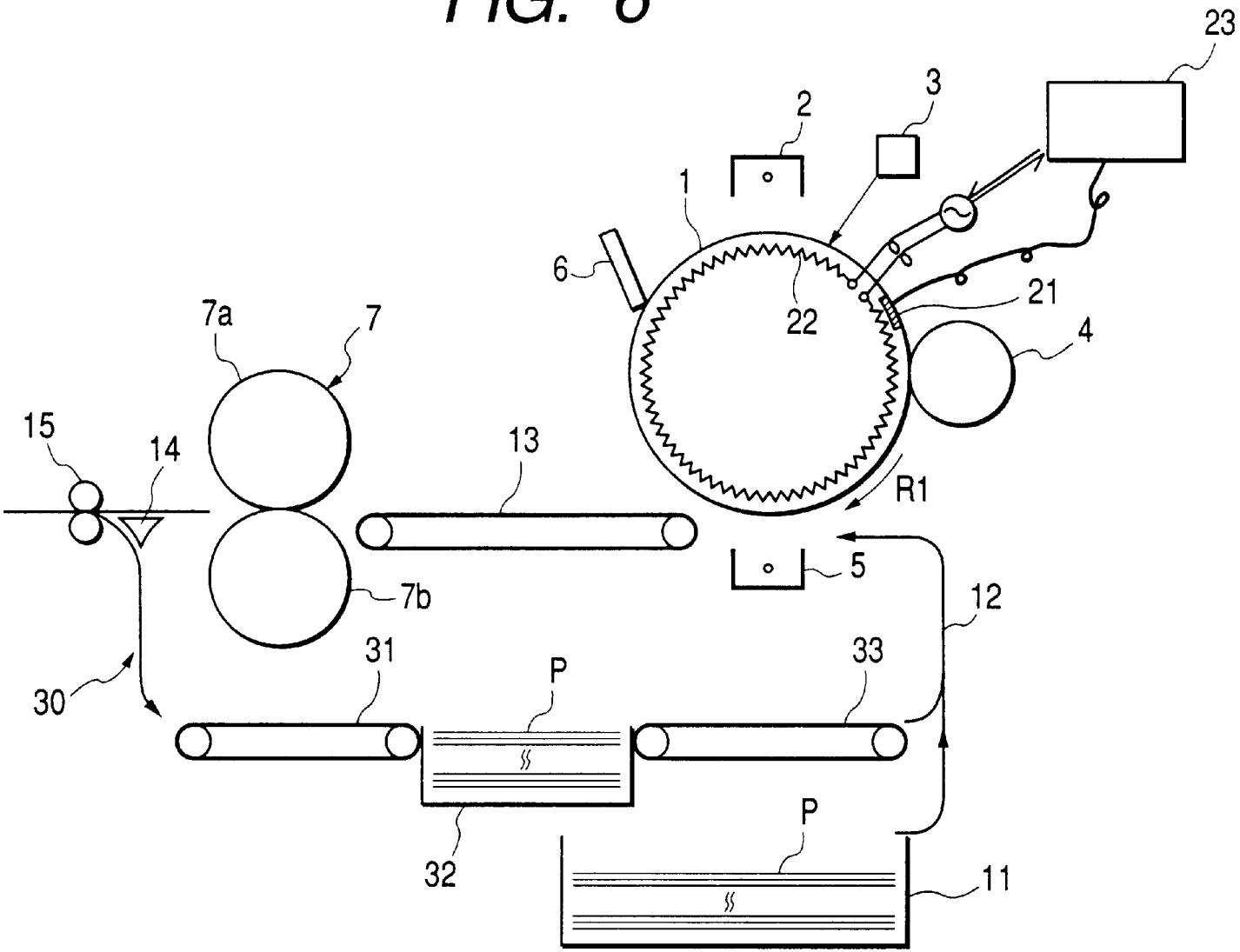
FIG. 6 is a vertical cross-sectional view showing a schematic structure of a conventional image forming apparatus.

On the contrary, in the above-described conventional image forming apparatus shown in FIG. 6, the intermediate tray 32 is disposed in the re-feeding path 30, and the transfer material P is contained in the intermediate tray 32 once. Then, the image A is formed on one faces of a given number of transfer materials P together, and after those transfer materials P have been contained in the intermediate tray 32, the transfer materials P are re-fed to the feeding path 12 from the intermediate tray 32, and the image is formed on the other faces of the transfer materials P. Accordingly, because the transfer material P stops in the intermediate tray 32 once during a sequential process in the both-face mode, there arises such a problem that the image formation rate per unit of time in the both-face mode becomes low.

On the other hand, in the image forming apparatus shown in FIG. 1, the transfer material P on which the image A has been fixed by heating is re-supplied to the transfer portion T through the conveying path 12 in a short period of time in order to form the image B. Therefore, in the case where the temperature control of the image bearing member 1 due to the sheet heater 22 or the like is conducted in the same manner as in the conventional image forming apparatus shown in FIG. 6, the temperature of the photosensitive drum is caused to rise to more than a set temperature, resulting in the above-described cleaning failure.

Under the above circumstances, according to the present invention, preferred temperature control is conducted on the image bearing member 1 of the image forming apparatus shown in FIG. 1.

In this embodiment, the control value of the surface temperature of the image bearing member 1 is set with two levels. In the both-face mode, the surface temperature of the image bearing member 1 is controlled to a lower value than that in the one-face mode, to thereby prevent the temperature of the image bearing member 1 from unnecessarily rising. In this embodiment, the control value of the surface temperature in the both-face mode is set to a lower value than that in the one-face mode by about 5 to 10° C. Specifically, the control values are set to 35° C. in the both-face mode and 40° C. in the one-face mode.

The embodiment will be described in more detail.

First, an amorphous silicon (a-Si) drum of 108 mm in diameter is used for the image bearing member 1. Also, polyurethane rubber of 76° C. in rubber hardness and 3 mm in thickness is used as the cleaning blade 6. In this embodiment, the sheet heater 22 attached to the image bearing member 1 is 40 W. The set temperatures of the image bearing member 1 are set to 35° C. in the both-face mode and 40° C. in the one-face mode.

First, when a power switch (not shown) of the apparatus body turns on, a printer is enabled, and standby such that the temperature of the fixing device is allowed to rise to a given temperature and the surface state of the photosensitive member is stabilized starts. That is, at the same time when the power switch turns on, the power supply to the sheet heater 22 starts so that the temperature rises up to 40° C. of the set temperature. During the standby of the apparatus, the control means 23 controls the power supply to the heater 22 so that the detected temperature of the thermistor 21 is maintained at 40° C.

Upon inputting a print command to the printer through a personal computer or a copy button which is connected to the printer, the printer starts to feed a sheet from the cassette 11 to start print. In this state, if the print command is indicative of both-face printing, the control means 23 makes the set temperature of the thermistor 21 fall down to 35° C. Thereafter, upon completion of printing the set number of transfer materials, the control means 23 again raises the set temperature to 40° C.. On the other hand, in case of the one-face printing, the set temperature is maintained at 40° C., the same temperature as in the state of standby to conduct printing.

Figure 3:
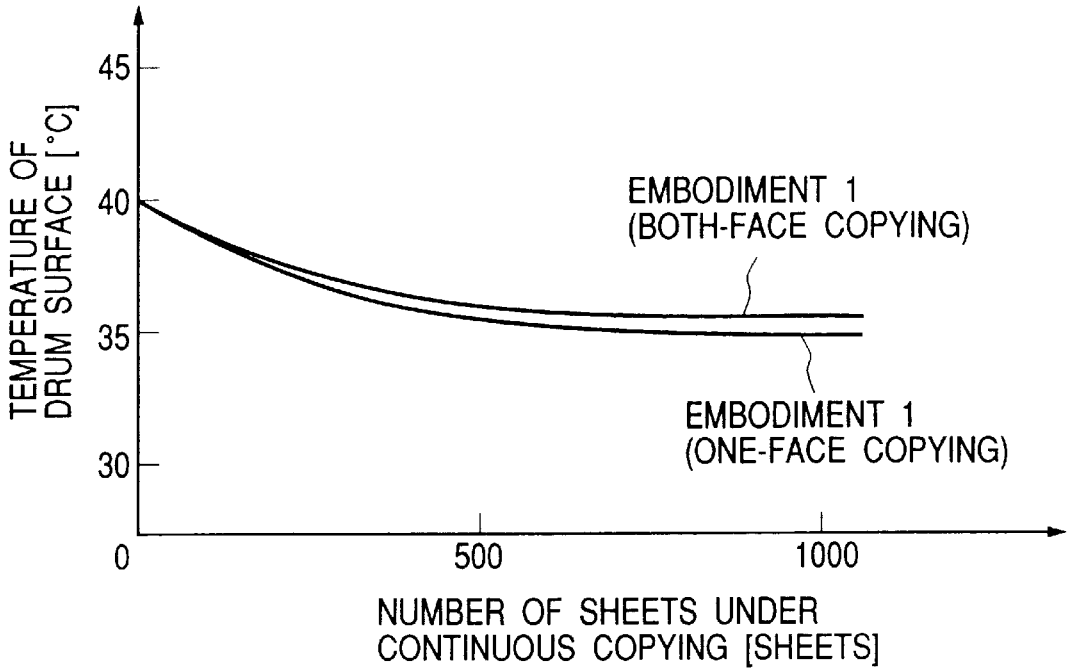
FIG. 3 is a graph representing a relation between a number of sheets under continuous copying and a drum surface temperature in case of one-face coping and both-face copying in accordance with Embodiment 1.

Subsequently, the relationships between the number of sheets under continuous copying (the number of sheets under continuous image formation) and the drum surface temperature (the surface temperature of the image bearing member 1) in the respective modes of the one-face copying and the both-face copying are shown in FIG. 3 (Embodiment 1), FIG. 4 (Comparative example 1) and FIG. 5 (Conventional example 1). In this description, Embodiment 1 is directed to a case in which the image forming apparatus (through-pass both-face system) shown in FIG. 1 is used, and the set temperatures of the image bearing member 1 are set to 35° C. in the both-face mode and 40° C. in the one-face mode. Comparative example 1 is directed to a case in which the image forming apparatus shown in FIG. 1 is used, and the set temperature of the image bearing member 1 is set to 40° C. in both of the both-face mode and the one-face mode. Conventional example 1 is adirected to a case in which the image forming apparatus (intermediate tray both-face method) shown in FIG. 6 is used, and the set temperature of the image bearing member 1 is set to 40° C. in both of the both-face mode and the one-face mode.

Figure 4:
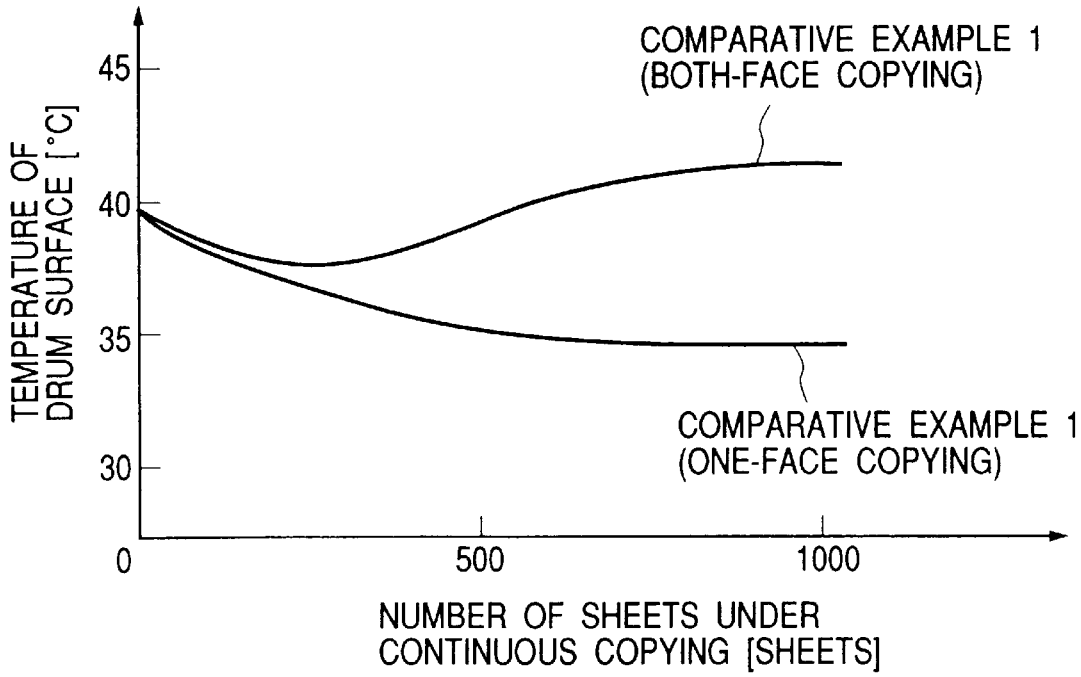
FIG. 4 is a graph representing a relation between a number of sheets under continuous copying and a drum surface temperature in case of one-face coping and both-face copying in Comparative example 1.
Figure 5:
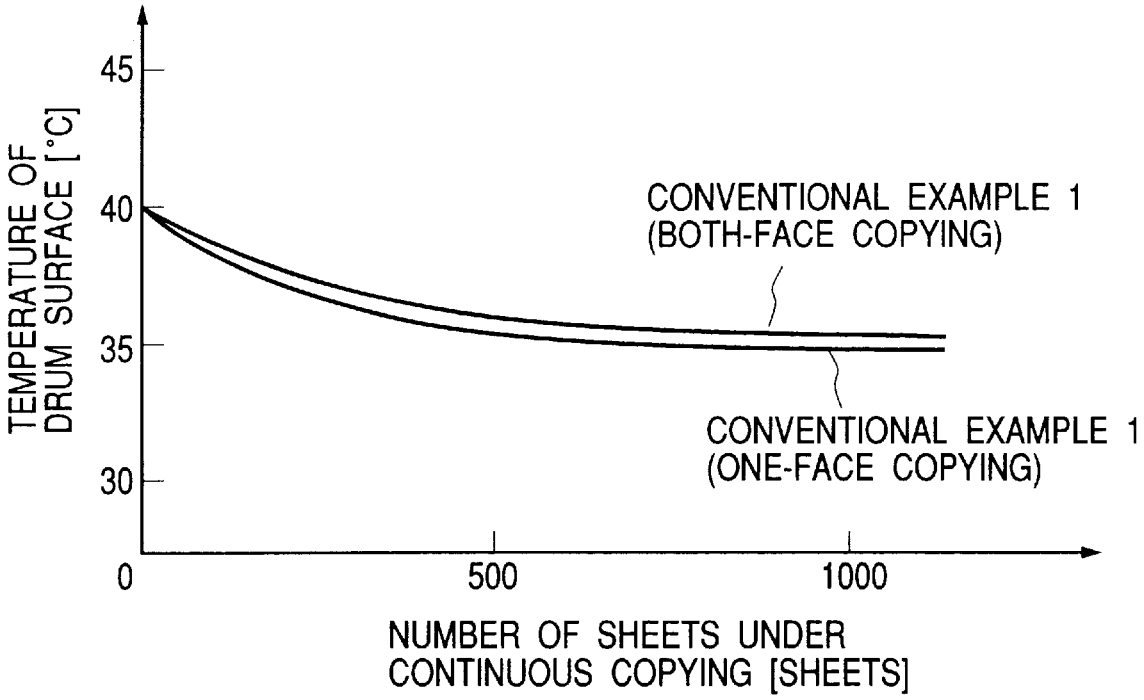
FIG. 5 is a graph representing a relation between a number of sheets under continuous copying and a drum surface temperature in case of one-face coping and both-face copying in Conventional example 1.

As is apparent from FIGS. 3 to 5, the drum surface temperature reaches 43 to 44° C. including overshoot in the both-face copying (both-face mode) in Comparative example 1 whereas the drum surface temperature is suppressed to about 36° C. in Embodiment 1. Although the drum surface temperature in Conventional example 1 is substantially identical with that in this embodiment, the number of output sheets per unit of time is remarkably smaller than that in Embodiment 1. In the one-face copying (one-face mode), the drum surface temperature is balanced at about 35° C. due to the heat absorption by the transfer material P in both of Comparative example 1 and Embodiment 1.

FIG. 7 shows the evaluated results of the above-described Embodiment 1, Comparative Example 1 and Conventional example 1 together.

In Embodiment 1, as shown in the evaluated results, in the both-face mode of the through-path both-face method, the set value of the drum. surface temperature is made to fall. As a result, the drum surface temperature at the time of the both-face image formation does not extremely rise, and a good cleaning performance (CLN performance) can be held, and an excellent image forming capability such that the number of image formation sheets per unit of time in the both-face mode is not inferior to that in the one-face mode is exhibited.

(Embodiment 2)

In this embodiment, the sheet heater 22 of the image bearing member 1 is turned off at the time of the image formation in the both-face mode.

As described above, actually in the image forming apparatus of the through-pass both-face method, since the process of forming the image on the second face of the transfer material P is again executed immediately (in a short period of time) after the image A is formed and fixed on the first face of the transfer material P, the heat transfer from the transfer material P to the image bearing member 1 occurs, and the temperature of the image bearing member 1 rises.

Accordingly, in this embodiment, with regard to the both-face mode, in order that the surface temperature of the image bearing member 1 is prevented from extremely rising, the power supply to the sheet heater 22 of the image bearing member 1 is turned off by the control means 23 (refer to FIG. 1).

Likewise, in this embodiment, there is exhibited an excellent image forming capability that the cleaning failure does not occurs in both of the both-face mode and the one-face mode, and the number of image formation sheets per unit of time in the both-face mode is not inferior to that in the one-face mode.

The present invention is not limited to the above-described embodiments but includes the modifications of the same technical concept.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus for forming an image on a recording material, comprising:

an image bearing member;

a heater for heating said image bearing member; and control means for controlling said heater so that a temperature of said image bearing member is maintained at a set temperature, wherein the set temperature when images are formed on both faces of a recording material is set to be lower than the set temperature when an image is formed on one face of a recording material.

2. An image forming apparatus according to claim 1, further comprising image forming means for forming an image on said image bearing member in accordance with an image signal.

3. An image forming apparatus for forming an image on a recording material, comprising:

an image bearing member;

a heater for heating said image bearing member; and control means for controlling said heater so that a temperature of said image bearing member is maintained at a set temperature, wherein said control means controls the temperature of said image bearing member when an image is formed on one face of a recording material and continues to turn off a power supply to the heater when images are formed on both faces of a recording material.

4. An image forming apparatus according to claim 3, further comprising image forming means for forming an image on said image bearing member in accordance with an image signal.

5. An image forming apparatus according to claim 1, wherein, when a both-face image-formation is performed, the recording material on the one face of which the image has been formed is re-conveyed to said image bearing member without being temporarily contained in a recording material containing portion.

6. An image forming apparatus according to claim 5, wherein, when both-face image-formations are performed more than once, a re-feed of the recording material on the one face of which the image has been formed and a feed of the recording material on which no image has been yet formed are alternated.

7. An image forming apparatus according to claim 3, wherein, when a both-face image-formation is performed, the recording material on the one face of which the image has been formed is re-conveyed to said image bearing member without being temporarily contained in a recording material containing portion.

8. An image forming apparatus according to claim 7, wherein, when both-face image-formations are performed more than once, a re-feed of the recording material on the one face of which the image has been formed and a feed of the recording material on which no image has been yet formed are alternated.

* * * * *

UNITED STATES PATENT AND TRADEMARK OFFICE

CERTIFICATE OF CORRECTION

PATENT NO. : 6,347,206 B1
DATED : February 12, 2002
INVENTOR(S) : Makoto Jinzai

It is certified that error appears in the above-identified patent and that said Letters Patent is hereby corrected as shown below:

Column 1,
Line 48, "tailing" should read -- trailing --.
Line 49, "passed" should read -- passes --.

Column 2,
Line 20, "the" should read -- and the --.
Line 32, "those" should read -- the --.
Line 66, "every" should read -- each of --.

Column 4,
Lines 10, 14 and 18, "coping" should read -- copying --.

Column 5,
Line 9, "an" should read -- a --.
Line 22, "supply 23" should read -- supply 24 --.
Line 32, "discharger" should read -- discharge --.
Line 33, "tailing" should read -- trailing --.

Column 6,
Lines 41 and 46, "faces" should read -- face --.

Column 7,
Line 13, "76º C.." should read -- 76º C. --.
Line 16, "40 w." should read -- 40º C. --.
Line 58, "adirected" should read -- directed --.

Column 8,
Line 13, "drum." should read -- drum --.
Line 41, "occurs" should read -- occur --.

Signed and Sealed this

Twenty-fifth Day of June, 2002

*Attest:*

*Attesting Officer*

JAMES E. ROGAN
*Director of the United States Patent and Trademark Office*